US007279844B2

(12) United States Patent
Winkel et al.

(10) Patent No.: US 7,279,844 B2
(45) Date of Patent: Oct. 9, 2007

(54) ELECTRONIC BALLAST

(75) Inventors: Michael Winkel, Lüdenscheid (DE); Franz Tusch, Plettenberg (DE)

(73) Assignee: HEP Tech Co. Ltd., RC Taichung (TW)

( * ) Notice: Subject to any disclaimer, the term of this patent is extended or adjusted under 35 U.S.C. 154(b) by 0 days.

(21) Appl. No.: 10/544,518

(22) PCT Filed: Feb. 2, 2004

(86) PCT No.: PCT/EP2004/000921

§ 371 (c)(1),
(2), (4) Date: Nov. 2, 2005

(87) PCT Pub. No.: WO2004/071135

PCT Pub. Date: Aug. 19, 2004

(65) Prior Publication Data

US 2006/0103327 A1 May 18, 2006

(30) Foreign Application Priority Data

Feb. 4, 2003 (DE) ..... 103 04 544

(51) Int. Cl.
*H05B 41/14* (2006.01)

(52) U.S. Cl. ..... 315/94; 31/94; 31/224; 31/291

(58) Field of Classification Search ..... 315/94, 315/209 R, 224–226, 244, 291
See application file for complete search history.

(56) References Cited

U.S. PATENT DOCUMENTS

| | | | | |
|---|---|---|---|---|
| 5,406,174 A | | 4/1995 | Slegers | 315/219 |
| 5,510,681 A | * | 4/1996 | Nilssen | 315/219 |
| 5,656,891 A | * | 8/1997 | Luger et al. | 315/94 |
| 5,737,207 A | * | 4/1998 | Uratani et al. | 363/132 |
| 5,854,538 A | | 12/1998 | Krummel | 315/105 |
| 5,959,408 A | * | 9/1999 | Steel et al. | 315/106 |
| 6,307,329 B1 | * | 10/2001 | Beij et al. | 315/224 |
| 6,348,769 B1 | | 2/2002 | Pinchuk et al. | 315/307 |
| 6,555,970 B2 | | 4/2003 | Schemmel et al. | 315/219 |

FOREIGN PATENT DOCUMENTS

| | | |
|---|---|---|
| DE | 3312572 | 10/1984 |
| DE | 19920030 | 11/2000 |
| DE | 19923083 | 1/2001 |

(Continued)

*Primary Examiner*—Thuy V. Tran
*Assistant Examiner*—Dieu Hien T Duong
(74) *Attorney, Agent, or Firm*—Collard & Roe, P.C.

(57) ABSTRACT

The invention relates to a ballast for low-pressure discharge lamps, comprising a controllable inverter circuit for the generation of a high-frequency supply voltage for a discharge lamp (1), a lamp inductance ($L_1$) connected to the inverter circuit, a lamp parallel capacitor ($C_1$) which is serially connected to the lamp inductance ($L_1$) and connected in parallel to the discharge lamp (1), and a preheating circuit supplying heating current to the electrodes (2, 3) of the discharge lamp (1). In order to minimize electrical losses and to enable universal use of said ballast for various types of discharge lamps the invention proposes that current is supplied to the preheating circuit via an auxiliary winding (7) arranged on the lamp inductance ($L_1$) with said auxiliary winding (7) being connected with the preheating circuit via a controllable switch or a parallel resonant circuit (9).

4 Claims, 1 Drawing Sheet

FOREIGN PATENT DOCUMENTS

| | | |
|---|---|---|
| DE | EP 1 225 792 | 7/2002 |
| EP | 0491434 | 6/1992 |
| EP | 0769889 | 4/1997 |
| FR | 2446579 | 8/1980 |
| WO | WO99/60825 | 11/1999 |

* cited by examiner

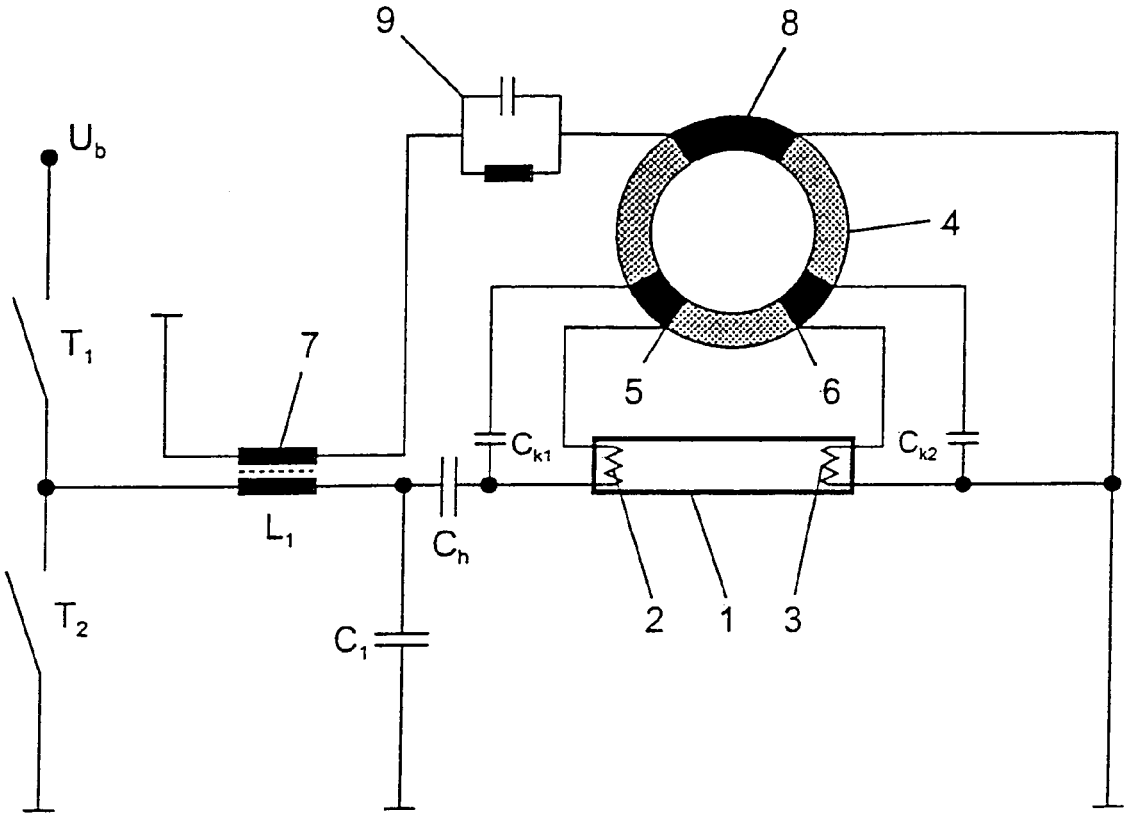
9
8
$U_b$
4
$T_1$
7
5
6
$C_{k1}$
$C_{k2}$
$L_1$
$C_h$
$T_2$
2
1
3
$C_1$

ELECTRONIC BALLAST

CROSS REFERENCE TO RELATED APPLICATIONS

Applicants claim priority under 35 U.S.C. §119 of German Patent Application No. 103 04 544.9 filed Feb. 4, 2003. Applicants also claim priority under 35 U.S.C. §365 of PCT/EP2004/000921 filed Feb. 2, 2004. The international application under PCT. article 21(2) was not published in English.

BACKGROUND OF THE INVENTION

1. Field of the Invention

The invention relates to a ballast for low-pressure discharge lamps, comprising a controllable inverter circuit for the generation of a high-frequency supply voltage for a discharge lamp, a lamp inductance connected to the inverter circuit, a lamp parallel capacitor which is serially connected to the lamp inductance and connected in parallel to the discharge lamp, and a preheating circuit supplying heating current to the electrodes of the discharge lamp.

2. The Prior Art

Such a ballast is known, for example, from what has been disclosed in DE 199 20 030 A1. Using the preheating circuit the electrodes of the discharge lamp designed in the form of heating coils are preheated so that a thermionic emission is initiated. For the ignition of the discharge lamp the frequency of the supply voltage is varied from a preheating frequency to an operating frequency with the help of the controllable inverter circuit. This will cause resonance in the series resonance circuit formed by the lamp inductance and the lamp parallel capacitor so that an ignition voltage is applied to the discharge lamp which is sufficient for ignition purposes.

The prior-art ballast is equipped with a heating transformer the primary winding of which is connected in series, with the lamp parallel capacitor. The secondary windings of the heating transformer supply heating current to the electrodes of the discharge lamp said electrodes being designed in the form of heating coils. The preheating voltage applied to the primary winding of the heating transformer is thus exclusively governed by the voltage drop across the lamp parallel capacitor. During the transient period when the preheating frequency changes until the operating frequency is reached this voltage increases causing the heating current to go up as well. However, the heating current is limited as a result of the saturation occurring in the heating transformer. Upon ignition of the discharge lamp the voltage impressed on the lamp parallel capacitor collapses and drops to the operating voltage level of the lamp. The heating current flowing through the heating coils of the electrodes when the lamp's operating state is reached decreases accordingly.

A drawback with such prior-art ballast is, however, that even during the ongoing operation of the discharge lamp a heating current is constantly applied which leads to higher power consumption. This is due to the fact that during lamp operation the primary winding of the heating transformer is constantly supplied with reactive current flowing through the lamp parallel capacitor. Another disadvantage to be associated with the prior-art ballast is experienced when the discharge lamp is switched on causing an undesirably high heating current to flow through the cold heating coils of the discharge lamp's electrodes. The heating current is only be limited by the saturation of the heating transformer. In the event the prior-art ballast is used with discharge lamps having particularly sensitive electrodes damage of the heating coils may occur.

SUMMARY OF THE INVENTION

Proceeding from these considerations it is the object of the present invention to provide an electronic ballast for low-pressure discharge lamps that is designed such that losses caused by the preheating circuit are minimized and which can be universally used, in particular also for discharge lamps equipped with sensitive electrodes.

Based on a ballast of the kind described above this objective is reached in such a manner that current is supplied to the preheating circuit via an auxiliary winding arranged on the lamp inductance with said auxiliary winding being connected with the preheating circuit via a controllable switch or a parallel resonant circuit.

Due to the fact that, according to the invention, current is supplied to the preheating circuit of the ballast via an auxiliary winding arranged on the lamp inductance the power supply of the preheating circuit—other than with the prior-art ballast—is not dependant on the reactive current flowing through the lamp parallel capacitor. Moreover, by making use of an auxiliary winding located on the lamp inductance another advantage is gained in that the heating current arising during the cut-in operation can be gradually increased by slowly lowering the supply voltage frequency from a high preheating frequency down to operating frequency. In this way an excessively high and for the electrodes of the discharge lamp harmful heating current is avoided. It is also beneficial that with the ballast according to the invention the power supply to the preheating circuit can be interrupted with the aid of a controllable switch or by means of the parallel resonant circuit while the lamp is operating continuously. This results in effectively eliminating undesirable losses otherwise arising because of the heating current which is constantly flowing during lamp operation. As controllable switch a transistor can be used in a customary manner by means of which the electrical connection between the auxiliary winding arranged on the lamp inductance and the preheating circuit is interrupted.

It is considered advantageous when the preheating circuit of the ballast according to the invention comprises a heating transformer the primary winding of which is connected with the auxiliary winding and whose secondary winding is connected with the electrodes of the discharge lamp. Accordingly, the primary winding is fed by the auxiliary winding arranged on the lamp inductance, with one secondary winding each being provided for heating one electrode of the discharge lamp. The saturation effect which occurs in the heating transformer when a heavy current flows through the lamp inductance can be utilized for the purpose of limiting the heating current. It is viewed expedient for this purpose to provide a heating transformer which is of toroidal design.

Expediently, with the ballast according to the invention the frequency of the supply voltage should be variable by means of the controllable inverter circuit ranging from a preheating frequency for electrode preheating to a different operating frequency used for the continuous operation of the discharge lamp. In a particularly simple wiring manner the power supply to the preheating circuit may then be interrupted in such a manner that the parallel resonant circuit connected between auxiliary winding on the lamp inductance and the preheating circuit is suitably matched to the operating frequency of the discharge lamp.

BRIEF DESCRIPTION OF THE DRAWING

An embodiment of the ballast according to the invention is explained below by way of the circuit shown in the diagram.

DETAILED DESCRIPTION OF PREFERRED EMBODIMENTS

A supply voltage $U_b$ is applied to a half-bridge consisting of two solid-state switches $T_1$ and $T_2$. The half-bridge circuit consisting of the two solid-state switches $T_1$ and $T_2$ forms part of a controllable inverter circuit for the generation of a high-frequency supply voltage for a discharge lamp 1. As necessitated by the desired frequency of the supply voltage the solid-state switches $T_1$ und $T_2$ are alternately activated and deactivated by an electronic control circuit not shown in more detail in the diagram. Via lamp inductance $L_1$ the discharge lamp 1 is connected with the half-bridge consisting of the two switches $T_1$ and $T_2$. A lamp parallel capacitor $C_1$ is connected in parallel with discharge lamp 1 and serially connected to lamp inductance $L_1$. Furthermore, a preheating circuit is provided via which heating current is supplied to electrodes 2 and 3 of discharge lamp 1. The preheating circuit consists of a toroidal transformer 4 the secondary windings 5 and 6 of which are connected to electrodes 2 and 3. In accordance with the invention current is supplied to the preheating circuit by an auxiliary winding 7 arranged on lamp inductance $L_1$. Auxiliary winding 7 is connected to a primary winding 8 of the toroidal transformer 4 with a parallel resonant circuit 9 being connected between auxiliary winding 7 and primary winding 8. Parallel resonant circuit 9 is matched to the operating frequency of discharge lamp 1 in such a way that during continuous operation of discharge lamp 1 only a minimum current flows through primary winding 8 of the toroidal transformer 4. According to the embodiment shown in the figure capacitors $C_k$, and $C_{k2}$ have been provided and serve for direct-current decoupling. Capacitor $C_h$ connected between lamp inductance $L_1$ and discharge lamp 1 also serves the purpose of direct-current decoupling.

Switching discharge lamp 1 on initially causes a supply voltage to be generated by means of solid-state switches $T_1$ and $T_2$ the frequency of which corresponds to that of a preheating frequency. The current flowing at this frequency through lamp inductance $L_1$ induces a voltage in auxiliary winding 7 that causes a current flow in primary winding 8 of the heating transformer 4. With the preheating frequency prevailing, the parallel resonant circuit 9 is distinctly outside its resonance range. The current flowing through primary winding 8 results in a current flowing through electrodes 2 and 3 which are fed via the secondary windings 5 and 6 of heating transformer 4. Now the frequency of the supply voltage is lowered by means of the controllable inverter circuit from preheating frequency to an operating frequency which is different and used for the continuous operation of discharge lamp 1. When said frequency is lowered the series resonant circuit consisting of lamp inductance $L_1$ and lamp parallel capacitor $C_1$ becomes resonant and causes an increasingly higher voltage to be applied to discharge lamp 1. As soon as the ignition voltage is reached discharge lamp 1 ignites and the voltage drops sharply until the operating voltage of discharge lamp 1 is reached. At operating frequency resonance prevails in the parallel resonant circuit 9 so that the heating current flowing through electrodes 2 and 3 is greatly reduced. While lamp 1 is in continuous operation only a minimum heating current thus flows through electrodes 2 and 3.

The invention claimed is:

1. Ballast for low-pressure discharge lamps, comprising a controllable inverter circuit for the generation of a high-frequency supply voltage for a discharge lamp (1), a lamp inductance ($L_1$) connected to the inverter circuit and serially connected to the discharge lamp (1), a lamp parallel capacitor ($C_1$) which is serially connected to the lamp inductance ($L_1$) and connected in parallel to the discharge lamp (1), and a preheating circuit supplying heating current to the electrodes (2, 3) of the discharge lamp (1), wherein said preheating circuit comprises a heating transformer (4) whose secondary windings (5, 6) are connected to electrodes (2, 3) of the discharge lamp (1), wherein the current is supplied to the preheating circuit via an auxiliary winding (7) arranged on the lamp inductance ($L_1$), said auxiliary winding (7) being connected to the primary winding (8) of said heating transformer (4) via a parallel resonant circuit (9).

2. Ballast according to claim 1, wherein the heating transformer (4) is of toroidal design.

3. Ballast according to claim 1, wherein the frequency of the supply voltage can be varied by means of the controllable inverter circuit from a preheating frequency for electrode (2, 3) preheating to a different operating frequency used for the continuous operation of the discharge lamp (1).

4. Ballast according to claim 3, wherein the parallel resonant circuit (9) is matched to the operating frequency in such a way that during continuous operation of the discharge lamp (1) the power supply of the preheating circuit is interrupted.

* * * * *